US010072404B2

(12) United States Patent
Geibel

(10) Patent No.: US 10,072,404 B2
(45) Date of Patent: Sep. 11, 2018

(54) SOLID FOOD WASTE MATERIAL COLLECTION DEVICE

(71) Applicant: Aaron R. Geibel, Seattle, WA (US)

(72) Inventor: Aaron R. Geibel, Seattle, WA (US)

( * ) Notice: Subject to any disclaimer, the term of this patent is extended or adjusted under 35 U.S.C. 154(b) by 638 days.

(21) Appl. No.: 14/711,142

(22) Filed: May 13, 2015

(65) Prior Publication Data

US 2016/0333558 A1 Nov. 17, 2016

(51) Int. Cl.
*E03C 1/264* (2006.01)
*B01D 35/28* (2006.01)

(52) U.S. Cl.
CPC ..... *E03C 1/264* (2013.01)

(58) Field of Classification Search
CPC ..... E03C 1/264; E03C 1/242
USPC ..... 241/46.13; 210/348
See application file for complete search history.

(56) References Cited

U.S. PATENT DOCUMENTS 3,874,006 A * 4/1975 Ritter ..... E03C 1/264 4/287
5,176,825 A * 1/1993 Hadjis ..... B01D 33/11 210/259
8,100,352 B2 * 1/2012 Ceru ..... E03C 1/2665 241/100
9,499,963 B2 * 11/2016 Ceru ..... B02C 23/36
9,694,362 B2 * 7/2017 Lang ..... B09B 3/00

* cited by examiner

*Primary Examiner* — Omar Flores Sanchez
(74) *Attorney, Agent, or Firm* — MacMillan, Sobanski & Todd, LLC

(57) ABSTRACT

A solid food waste material collection device is provided. The solid food waste material collection device includes a multi-port valve, an outer vessel in fluid communication with the multi-port valve and an inner vessel contained within the outer vessel and in fluid communication with the outer vessel. The inner vessel is configured to separate solid food waste materials from liquid wastes. The multi-port valve is configured to selectively direct food waste materials to the outer vessel or direct food waste materials to a drain system.

17 Claims, 8 Drawing Sheets

SOLID FOOD WASTE MATERIAL COLLECTION DEVICE

BACKGROUND

Food scraps and food waste materials typically include solid food waste materials mixed with liquids. Food scraps and food waste materials can be handled in differing manners. In some instances, food scraps and food waste materials are disposed of via garbage cans. In other instances, food scraps and food waste materials are run through a garbage disposal, with the resulting ground waste materials disposed of via conventional drain systems.

In certain jurisdictions, it is forbidden by state and/or municipal ordinance to dispose of or place solid food wastes and food soiled materials, such as paper, in a garbage can. In lieu of disposing of solid food wastes and food soiled materials in the garbage, special collection efforts are made and the resulting collected food wastes and food soiled materials are recycled through composting means.

In order to efficiently collect food scraps and food waste materials, it is desirable to separate the solid food waste materials from liquids mixed with the solid food waste materials. The separated solid food waste materials occupy less volume and the liquids can be disposed of via conventional drain systems.

It would be advantageous if solid food waste materials could be collected more efficiently.

SUMMARY

The above objects are achieved by a solid food waste material collection device. The solid food waste material collection device includes a multi-port valve, an outer vessel in fluid communication with the multi-port valve and an inner vessel contained within the outer vessel and in fluid communication with the outer vessel. The inner vessel is configured to separate solid food waste materials from liquid wastes. The multi-port valve is configured to selectively direct food waste materials to the outer vessel or direct food waste materials to a drain system.

According to this invention there is also provided a drain system. The drain system includes one or more sink basins and a garbage disposal fluidly connected to at least one of the sink basins. A solid food waste material collection device is configured to receive ground food waste materials from the garbage disposal. The solid food waste material collection device has a multi-port valve, an outer vessel in fluid communication with the multi-port valve and an inner vessel contained within the outer vessel and in fluid communication with the outer vessel. The inner vessel is configured to separate solid food waste materials from liquid wastes. At least one drain pipe is positioned downstream from the multi-port valve. The multi-port valve is configured to selectively direct food waste materials to the outer vessel or direct food waste materials to the at least one drain pipe.

According to this invention there is also provided a method of recycling solid food waste materials separated from liquid wastes. The method includes the steps of grinding food waste materials with a garbage disposal thereby forming ground food waste materials, conveying the ground food waste materials to a solid food waste material collection device, the solid food waste material collection device having a multi-port valve, an outer vessel in fluid communication with the multi-port valve and an inner vessel contained within the outer vessel and in fluid communication with the outer vessel, the inner vessel configured to separate solid food waste materials from liquid wastes, conveying the ground food waste materials into the inner vessel, receiving liquid waste materials exiting the inner vessel into the outer vessel, thereby forming solid food waste materials in the inner vessel, removing the inner vessel from the solid food waste material collection device and removing solid food waste materials from the inner vessel.

Various objects and advantages of the solid food waste material collection device will become apparent to those skilled in the art from the following detailed description of the preferred embodiment, when read in light of the accompanying drawings.

DETAILED DESCRIPTION OF THE INVENTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with illustrated embodiments of the present invention, the description and figures disclose a solid food waste material collection device. The solid food waste material collection device is configured to separate solid food waste materials from liquids mixed with the solid food waste materials. The separated solid food waste materials can be collected for recycling and the separated liquids can be disposed of via conventional drain systems.

The term "food scraps and food waste materials", as used herein, is defined to mean discarded or unused food. The term "solid food waste material", as used herein, is defined to mean that portion of the food scraps and food waste materials having a firm or hard composition. The term "liquid", as used herein, is defined to mean that portion of the food scraps and food waste material able to flow with a substantially constant volume.

Figure 1:
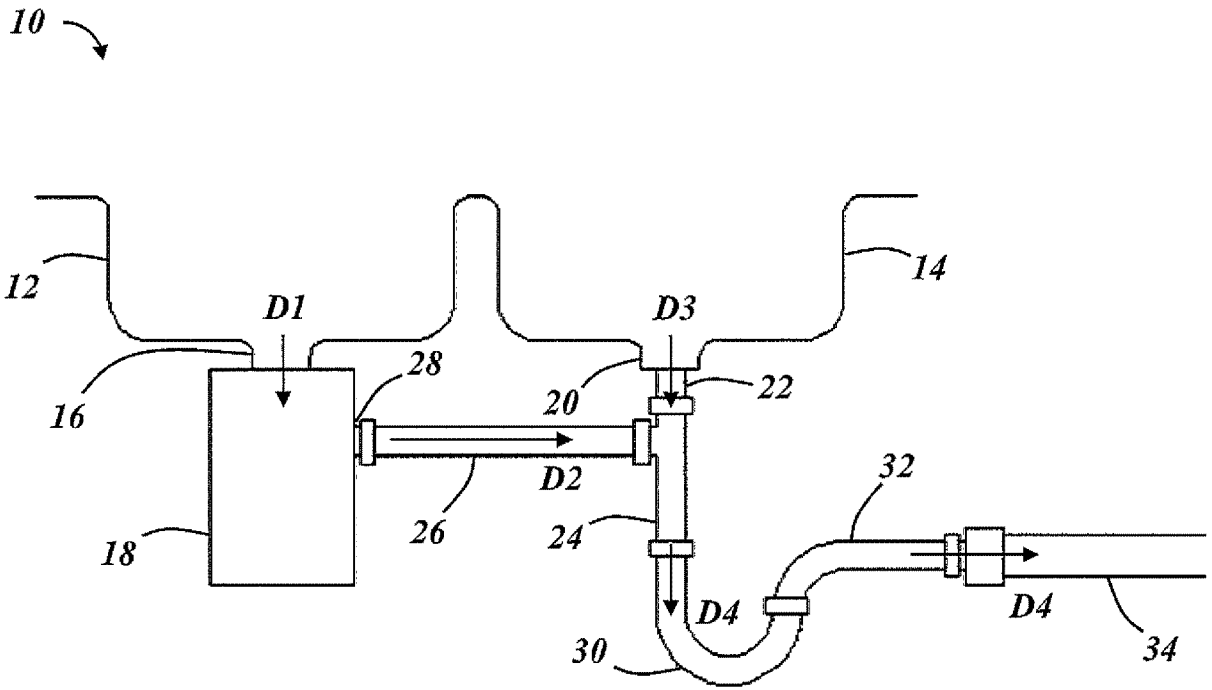
Fig. 1 Prior Art
FIG. 1 is a front view, in elevation, of a conventional multi-sink drain system.

Referring now to FIG. 1, a conventional multi-sink drain system is illustrated generally at 10. The system 10 includes a first sink basin 12 positioned approximate a second sink basin 14. The sink basins 12, 14 can have any desired shape, size and/or configuration and can be formed from any desired material or combination of materials. The first sink basin 12 has an outlet 16 connected to a garbage disposal 18. The garbage disposal 18 is conventional in the art.

Referring again to FIG. 1, the second sink basin 14 has an outlet 20 connected to a tail piece 22. The tail piece 22 is connected to a tee 24. A connector pipe 26 connects an outlet 28 of the garbage disposal 18 with the tee 24. Yet another branch of the tee 24 is connected to a trap 30. The trap 30 is connected to a drain elbow 32, which is in turn, connected to a drain pipe 34.

Referring again to FIG. 1, in operation the first sink basin 12 and the outlet 16 are configured such that food scraps and food waste materials can be urged out of the sink basin 12, through the outlet 16 and into the garbage disposal 18, as illustrated by direction arrow D1. The food scraps and food waste materials are ground by the garbage disposal and the ground materials are conveyed through connector pipe 26 to the tee 24 as indicated by direction arrow D2.

Referring again to FIG. 1, the second sink basin 14 and the outlet 20 are configured such that liquids are urged out of the sink basin 14, through the outlet 20, through the tail piece 22, and into the tee 24, as illustrated by direction arrow D3. The materials from the garbage disposal 18 flowing through the connector pipe 26 and the liquids flowing from the second sink basin 14 merge in the tee 24 and flow through the trap 30, trap elbow 32 and into the drain pipe 34 as illustrated by direction arrows D4.

Figure 2:
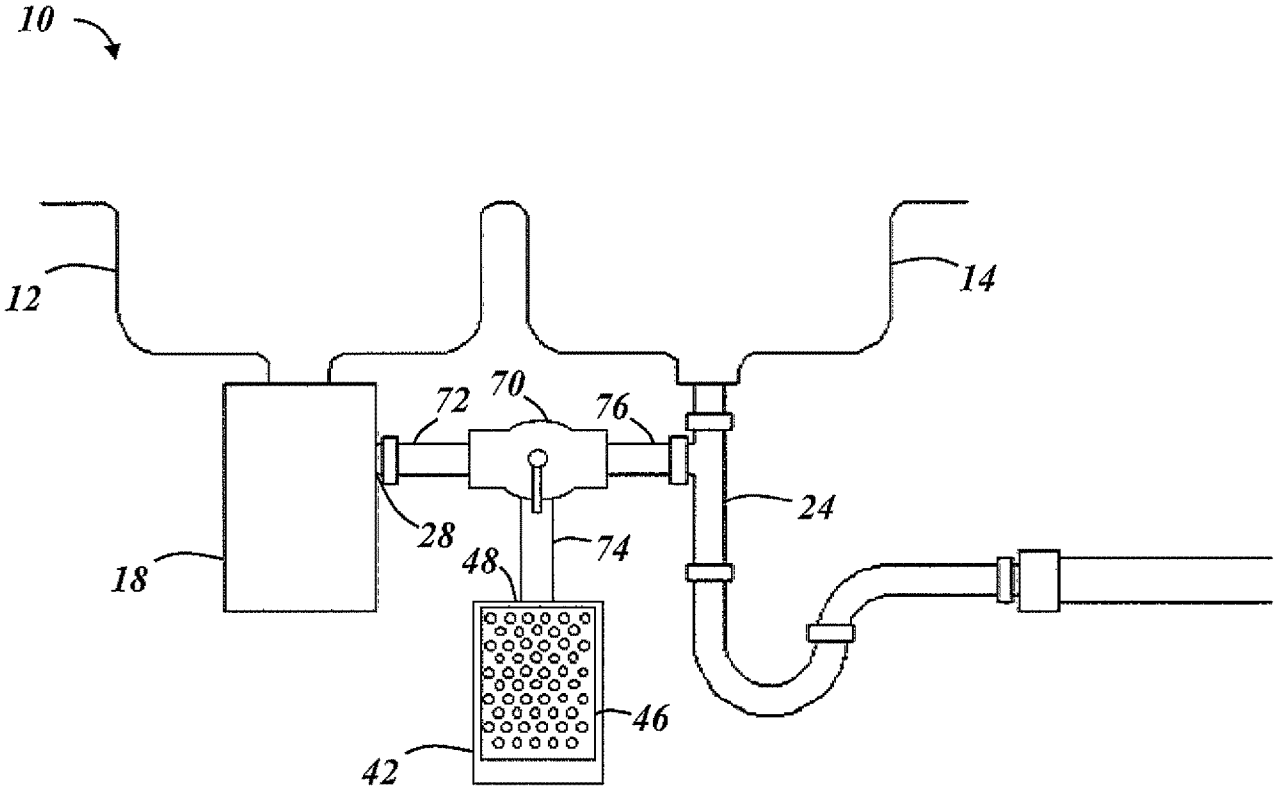
FIG. 2 is a front view, in elevation, of an improved multi-sink drain system illustrating a solid food waste material collection device.

Referring now to FIG. 2, an improved multi-sink drain system is illustrated generally at 40. Generally, the improved system 40 incorporates a solid food waste material collection device 42 (hereafter "collection device") into the system 10 described above and illustrated in FIG. 1. The collection device 42 is configured to separate solid food waste materials from liquids mixed with the solid food waste materials.

Referring again to FIG. 2, the collection device 42 is positioned downstream from the garbage disposal 18 and upstream from the tee 24. The collection device 42 is in fluid communication with the garbage disposal 18 and the tee 24. As will be explained in more detail below, the collection device 42 is configured to selectively divert materials flowing from the garbage disposal 18 or allow materials flowing from the garbage disposal 18 to flow through the collection device 42 to the tee 24.

Referring now to FIGS. 3-6, the collection device 42 will be described. The collection device includes an outer vessel 44, an inner vessel 46, a lid 48 and a valve assembly 50.

Referring again to FIGS. 3-6, the outer vessel 44 is configured to contain the inner vessel 46 and removably attach to the lid 48. The outer vessel 44 is further configured for fluid communication with the valve assembly 50. In the illustrated embodiment, the outer vessel 44 has a generally rectangular cross-sectional shape, although other shapes sufficient to contain the inner vessel 46, removably attach to the lid 48 and fluidly communicate with the valve assembly 50 can be used. In the illustrated embodiment, the outer vessel 44 is formed from a transparent, polymeric material, such as for example, polyurethane. In other embodiments, the outer vessel 44 can be formed from other desired materials, including bisphenol A. (BPA) free materials.

Figure 3:
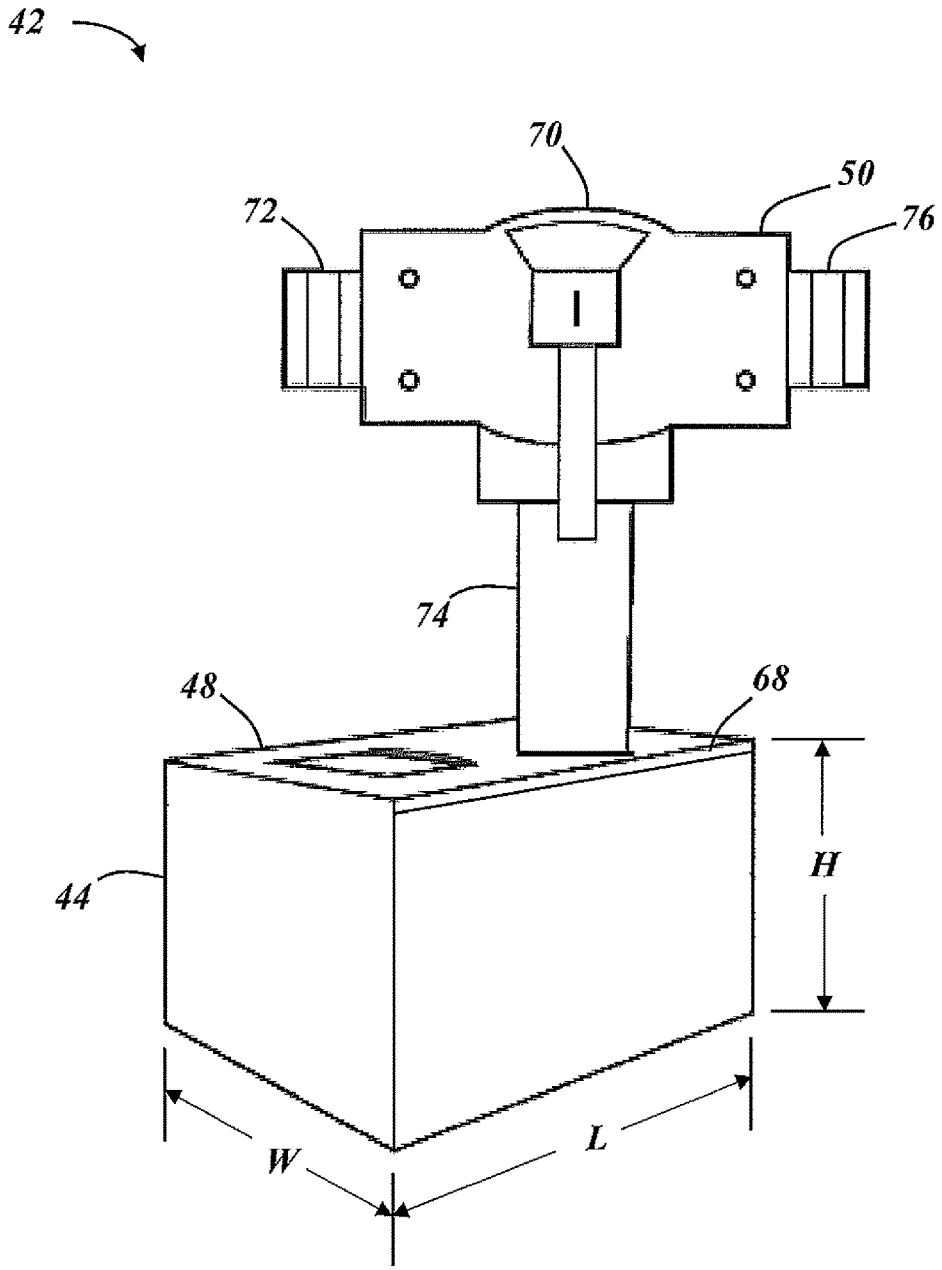
FIG. 3 is a partial perspective view of the solid food waste material collection device of FIG. 2.

Referring now to FIG. 3, the outer vessel 44 has a width W, a height H and a length L. In the illustrated embodiment, the width W is in a range of from about 2.0 inches to about 5.0 inches, the height H is in a range of from about 8.0 inches to about 14.0 inches and the length L is in a range of from about 8.0 inches to about 14.0 inches. However, it should be appreciated that in other embodiments, the outer vessel 44 can have a width W less than about 2.0 inches or more than about 5.0 inches, a height H less than about 8.0 inches or more than about 14.0 inches and a length L less than about 8.0 inches or more than about 14.0 inches. Advantageously, the compact size of the outer vessel 44 allows for placement of the collection device 42 within the confined spaces commonly found under sinks.

Figure 4:
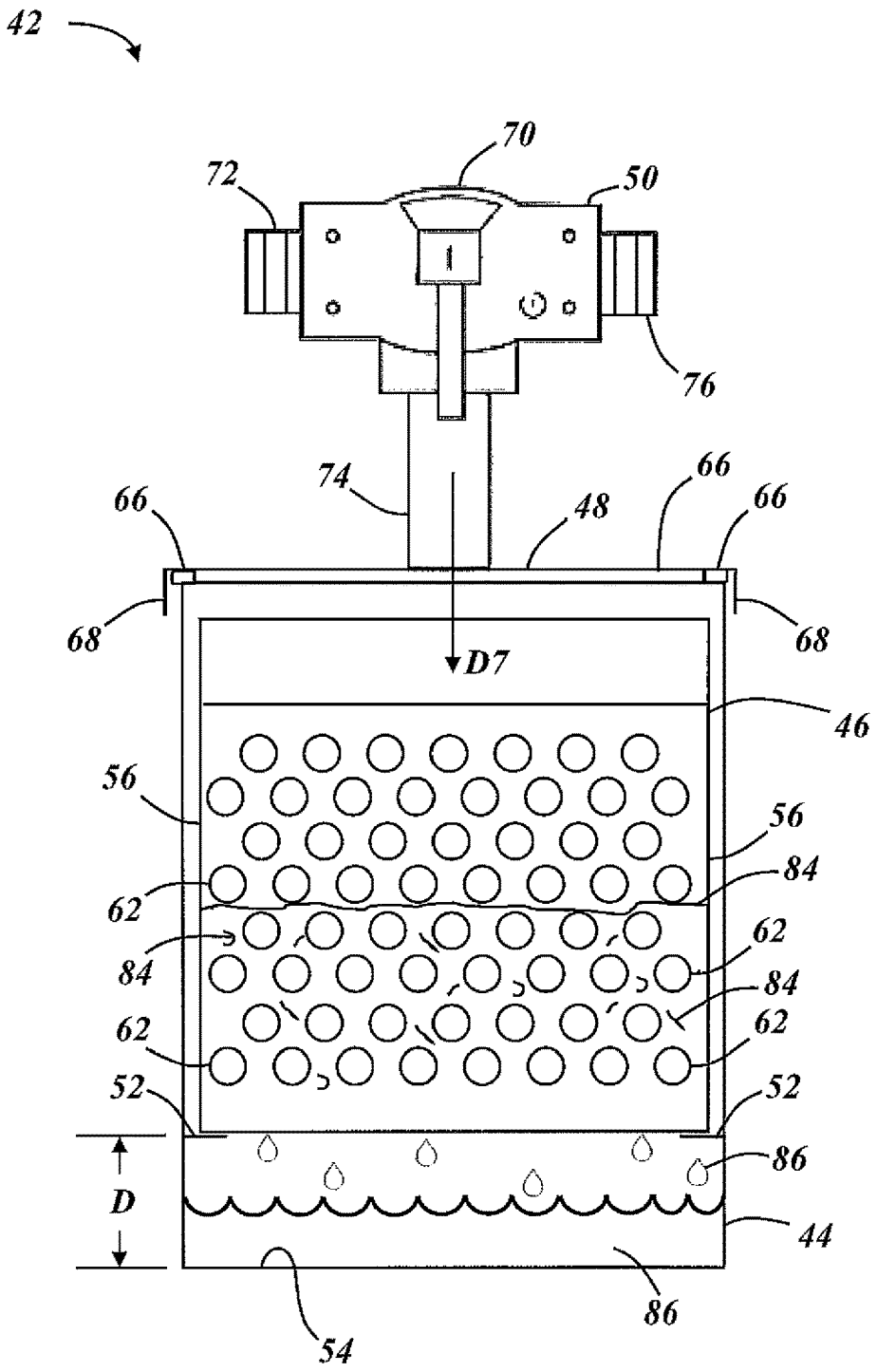
FIG. 4 is a front elevational view, partially in cross-section, of the solid food waste material collection device of FIG. 2, illustrating an accumulation of solid food waste material.

Referring now to FIG. 4, the outer vessel 44 includes a plurality of supports 52 positioned to support the inner vessel 46 a distance D from a bottom panel 54 of the outer vessel 44. In the illustrated embodiment, the supports 52 are formed as a rail, attached to the sidewalls of the outer vessel 44. However, in other embodiments, the supports 52 can be formed from other structures and devices, including the non-limiting examples of clips, clamps and brackets. In still other embodiments, the supports 52 can be formed from indents in the sidewalls of the outer vessel 44.

Referring again to FIG. 4, the distance D separating the inner vessel 46 from the bottom panel 54 of the outer vessel 44 is configured to separate liquids emanating from the food waste materials contained in the inner vessel 46. In the illustrated embodiment, the distance D is in a range of from about 2.0 inches to about 5.0 inches. Alternatively, the distance D can be less than about 2.0 or more than about 5.0 inches, sufficient to separate liquids emanating from the food waste materials contained in the inner vessel 46.

Figure 5:
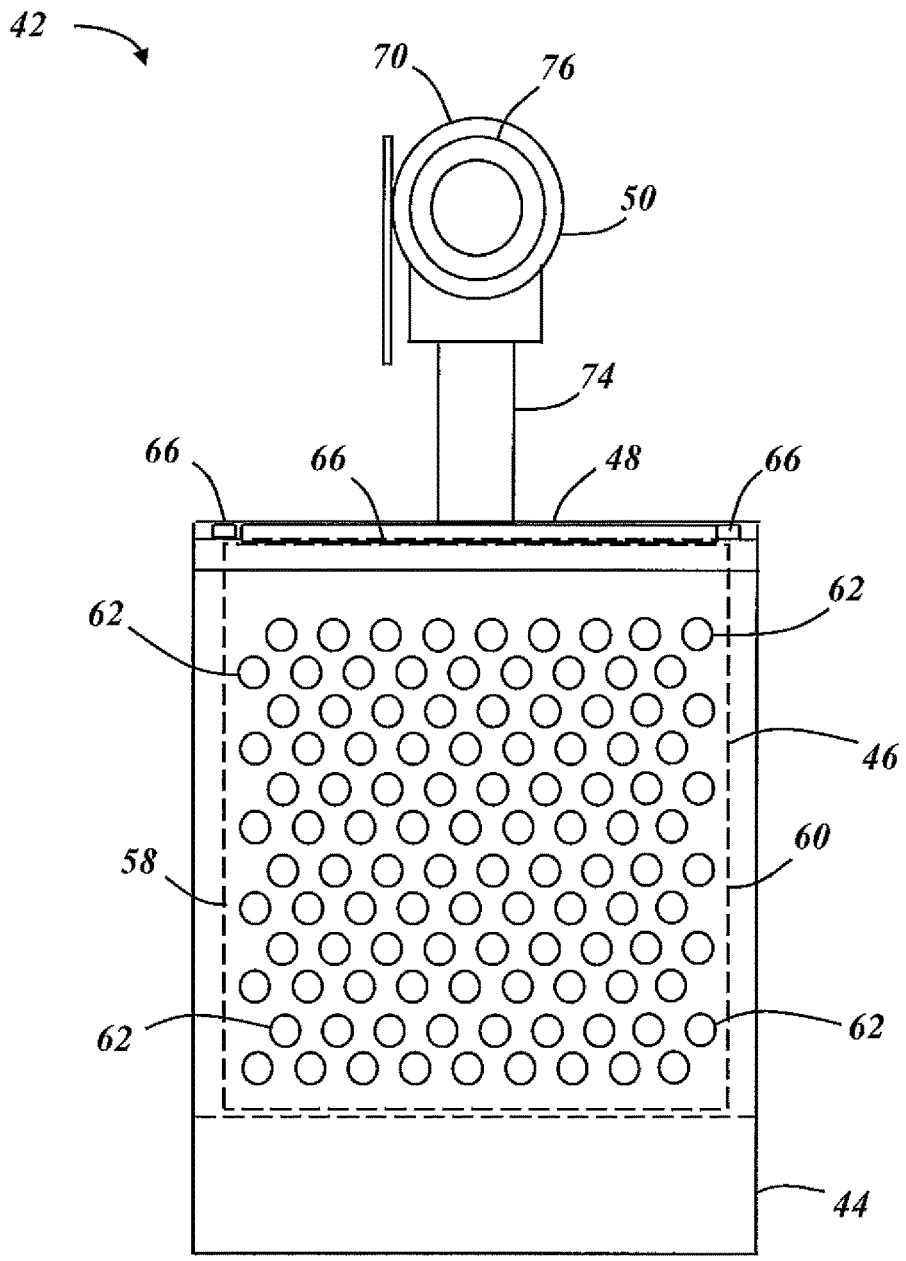
FIG. 5 is a side elevational view, partially in cross-section, of the solid food waste material collection device of FIG. 2, illustrating a plurality of apertures in an inner vessel.
Figure 6:
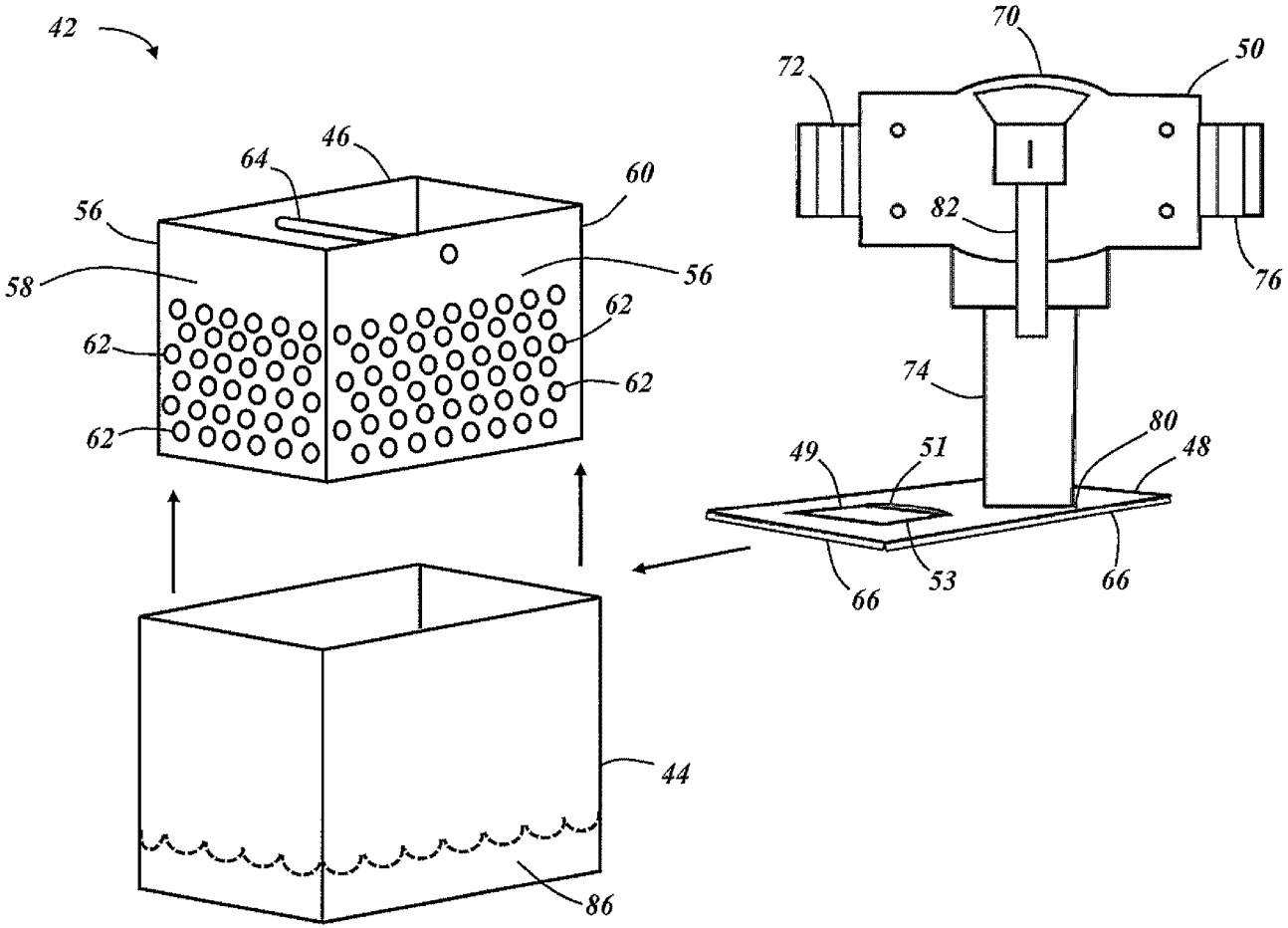
FIG. 6 is an exploded view of the solid food waste material collection device of FIG. 2.

Referring now to FIGS. 4-6, the inner vessel 44 is configured to receive and contain food waste materials directed by the valve assembly 50. The inner vessel 46 is contained within the outer vessel 44 and supported above the bottom panel 54 of the outer vessel 44. The inner vessel 46 is further configured for fluid communication with the valve assembly 50. In the illustrated embodiment, the inner vessel 46 has a generally rectangular cross-sectional shape, although other shapes sufficient for containment within the outer vessel 44 can be used. In the illustrated embodiment, the inner vessel 46 is formed from a transparent, polymeric material, such as for example, polyurethane. In other embodiments, the inner vessel 46 can be formed from other desired materials, including bisphenol A. (BPA) free materials.

Referring again to FIG. 4-6, the inner vessel 46 includes opposing sidewalls 56, a front wall 58 and a rear wall 60. The walls 56, 58 and 60 include a plurality of apertures 62. The apertures 62 are configured to allow liquids emanating from the food waste materials contained in the inner vessel 46 to exit the inner vessel 46 and collect in the bottom of the outer vessel 44. In the illustrated embodiment, the apertures 62 are arranged in rows and alternating columns. In other embodiments, the apertures 62 can be arranged in any desired pattern including a random pattern. In the illustrated embodiment, the apertures have a substantially circular shape with a diameter in a range of from about 0.25 inches to about 2.0 inches. However, in other embodiments the apertures can have other shapes, including the non-limiting example of a square shape and can have sizes less than about 0.25 inches or more than about 2.0 inches, sufficient to liquids emanating from the food waste materials contained in the inner vessel 46 to exit the inner vessel 46 and collect in the bottom of the outer vessel 44.

Referring now to FIG. 6, optionally the inner vessel 46 includes a handle 64 extending between the opposing sidewalls 56. The handle 64 is configured to facilitate removal of the inner vessel 46 from the outer vessel 44. The handle 64 can have any desired shape, size and arrangement, sufficient to facilitate removal of the inner vessel 46 from the outer vessel 44. However, it should be appreciated that the handle 64 is optional and not required for operation of the collection device 42.

Referring again to FIGS. 3-6, the lid 48 sits atop the outer vessel 44 and has a shape that approximates the perimeter edges of the walls 56, 58 and 60 of the outer vessel 44. The lid 48 includes a seal material 66 arranged to align with the perimeter edges of the walls 56, 58 and 60 of the outer vessel 44. The seal material 66 is configured seal the lid 48 with the walls 56, 58 and 60 of the outer vessel 44, such that odors from the food waste materials contained in the inner vessel 46 are substantially contained in the vessels 44, 46. In the illustrated embodiment, the seal material 66 is formed from a rubber-based material. However, in other embodiments, the seal material 66 can be formed from other desired materials, such as the non-limiting example of a polymeric material, sufficient to seal the lid 48 with the walls 56, 58 and 60 of the outer vessel 44, such that odors from the food waste materials contained in the inner vessel 46 are substantially contained in the vessels 44, 46.

Referring again to FIGS. 3 and 4, optionally the lid 48 can include side segments 68 extending in a substantially vertical direction from longitudinal edges. The side segments 68 are configured to assist in aligning the lid 48 to the perimeter edges of the walls 56, 58 and 60 of the outer vessel 44. The side segments 68 can have any desired shape, height, length or arrangement sufficient to assist in aligning the lid 48 to the perimeter edges of the walls 56, 58 and 60 of the outer vessel 44. However, it should be appreciated that the side segments 68 are not necessary for operation of the collection device 42.

Referring now to FIG. 6, optionally the lid 48 can include a lid flap 49. The lid flap 49 includes a hinged portion 51 and a seal 53. The lid flap 49 is configured to selectively open and close by rotating about the hinged portion 51. In operation, food waste materials, such as for example such as avocado pits and used coffee grounds can be inserted into the inner vessel 46 through the lid flap 49. The seal 53 is configured to seal the lid flap 49 with the lid 48 such that odors from the food waste materials contained in the inner vessel 46 are substantially contained in the vessels 44, 46.

Referring now to FIGS. 3-6, the valve assembly 50 includes a valve body 70 connected to an inlet valve branch 72, a first outlet branch 74 and a second outlet branch 76. As shown in FIG. 2, the inlet valve branch 72 is configured to fluidly connect the outlet 28 of the garbage disposal 18 with the valve body 70. In the illustrated embodiment, the inlet valve branch 74 is formed from piping made from polyvinyl chloride (PVC) of an appropriate size. However, the inlet valve branch 72 can be formed from other materials sufficient to fluidly connect to the outlet 28 of the garbage disposal 18 with the valve body 70.

Referring again to FIGS. 2 and 6, the first outlet branch 74 is configured to fluidly connect the valve body 70 with the inner vessel 46 via an aperture 80 in the lid 48. In the illustrated embodiment, the first outlet branch 74 is formed from piping made from polyvinyl chloride (PVC) of an appropriate size. However, first outlet branch 74 can be formed from other materials sufficient to fluidly connect the valve body 70 with the inner vessel 46 via an aperture 80 in the lid 48.

Referring again to FIGS. 2 and 6, the second outlet branch 76 is configured to fluidly connect the valve body 70 with the tee 24. In the illustrated embodiment, the second outlet branch 76 is formed from piping made from polyvinyl chloride (PVC) of an appropriate size. However, second outlet branch 76 can be formed from other materials sufficient to fluidly connect the valve body 70 with the tee 24.

Referring now to FIGS. 3-6, the valve body 70 is a multi-port valve configured to direct ground materials exiting the garbage disposal 18 either in the direction of the collection device 42 through the first outlet branch 74 or in the direction of the tee 24 through the second outlet branch 76. In the illustrated embodiment, operation of the valve body 70 is accomplished through a valve handle 82. Although in other embodiments, operation of the valve body 70 can be accomplished in other manners, such as the non-limiting example of an electric means.

Figure 7:
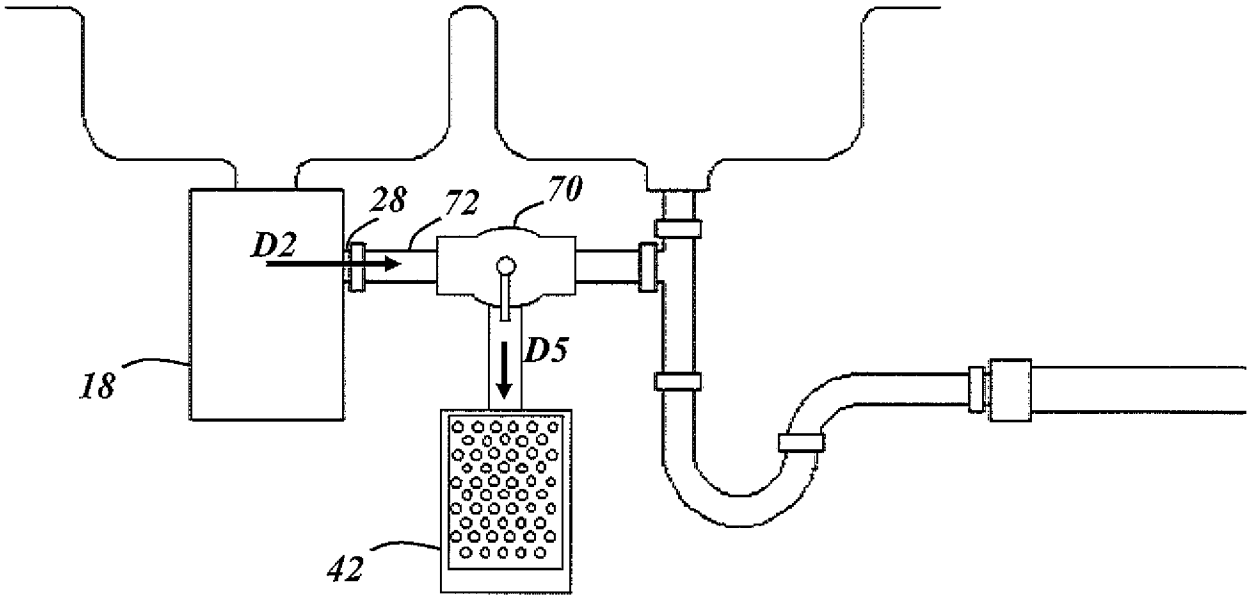
FIG. 7 is a front view, in elevation, of the improved multi-sink drain system of FIG. 2 illustrating a first operational mode.
Figure 8:
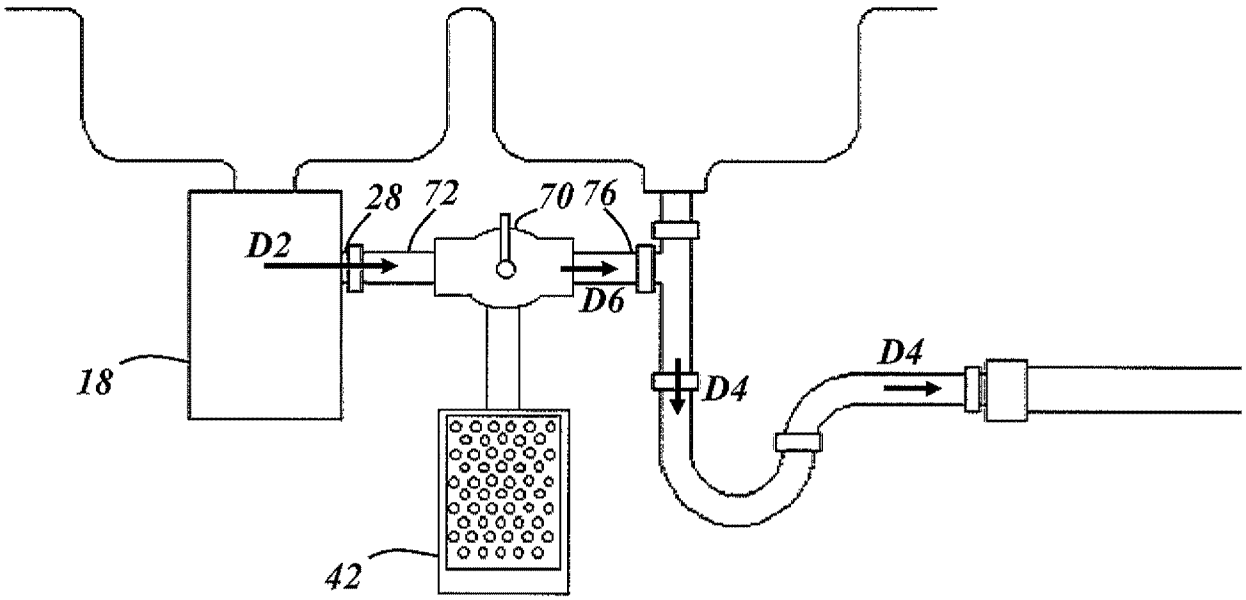
FIG. 8 is a front view, in elevation, of the improved multi-sink drain system of FIG. 2 illustrating a second operational mode.

Referring now to FIGS. 7 and 8, operation of the collection device 42 will be described. Ground food scraps and ground food waste materials exit the garbage disposal 18 through outlet 28 and are conveyed through the inlet valve branch 72 to the valve body 70. In a first scenario as shown in FIG. 7, the valve body 70 is configured to direct the ground materials to the collection device 42 as shown by direction arrow D5. Operation of the collection device 42 will be described below.

In a second operational scenario as shown in FIG. 8, the ground materials are directed by the valve body 70 through the second outlet branch 76 to the tee 24, as shown by direction arrow D6, and subsequently to the drain pipe 34. It should be clear that in the second operational scenario, the ground materials do not engage the collection device 42.

Referring now to FIG. 4, the ground materials enter the collection device 42 through the first outlet branch 74, as shown by direction arrow D7. The ground materials accumulate within the inner vessel 46 as illustrated by reference character 84. Simultaneously with the accumulation of the ground materials within the inner vessel 46, liquid waste 86 seeps through the apertures 62 and accumulates within the outer vessel 44.

Referring now to FIG. 6, at such time as it is desired to empty the collection device 42, the outer vessel 44 is removably slid from the lid 48 and the inner vessel 46 is removed from the outer vessel 44 by means of the handle 64. The accumulated ground materials can be discarded by desired means, such as for example composting. The accumulated liquid waste also can be discarded by desired means.

The collection device 42 provides significant benefits, although all benefits may not be present in all embodiments. First, the collection device 42 provides for easy recycling of food scraps and waste food materials by separating the liquid portion of the food scraps and waste food materials from the solid portions. Second, due to the compact configuration, the collection device 42 can be positioned such as to be out of view, such as under sinks and countertops. Third, the collection device 42 is configured to hold significant accumulations of waste material since the waste materials have been ground by the garbage disposal. Fourth, existing drain systems are able to maintain better drain flow due to a lesser amount of food scraps and food waste materials being present in the drain system. Fifth, the collection device 42 provides a convenient and steady supply of compacted food waste by maintaining composting processes. Sixth, the ground accumulated food waste materials will facilitate composting processes.

While the solid food waste material collection device 42 has been described above and shown in the Figures in relation to a multi-sink drain system, it should be appreciated that in other embodiments, the solid food waste material collection device 42 can be installed with drain systems having any quantity of sinks.

The principle and mode of operation of the solid food waste material collection device have been described in certain embodiments. However, it should be noted that the solid food waste material collection device may be practiced otherwise than as specifically illustrated and described without departing from its scope.

What is claimed is:

1. A solid food waste material collection device comprising:

a multi-port valve:

an outer vessel in fluid communication with the multi-port valve; and an inner vessel contained within the outer vessel and in fluid communication with the outer vessel, the inner vessel configured to separate solid food waste materials from liquid wastes, wherein the inner vessel is positioned a distance from a bottom panel of the outer vessel, the distance in a range of from about 2.0 inches to about 5.0 inches, wherein the multi-port valve is configured to selectively direct food waste materials to the outer vessel or direct food waste materials to a drain system.

2. The solid food waste material collection device of claim 1, wherein the inner vessel includes a plurality of apertures configured to allow liquid waste materials to exit the inner vessel.

3. The solid food waste material collection device of claim 2, wherein the liquid waste materials exiting the inner vessel are contained within the outer vessel.

4. The solid food waste material collection device of claim 1, wherein a lid is positioned atop the outer vessel.

5. The solid food waste material collection device of claim 4, wherein a seal material is positioned between the lid and the outer vessel.

6. The solid food waste material collection device of claim 4, where the lid includes a hinged lid flap configured to receive food waste materials into the inner vessel.

7. A drain system comprising:

one or more sink basins;

a garbage disposal fluidly connected to at least one of the sink basins;

a solid food waste material collection device configured to receive ground food waste materials from the garbage disposal, the solid food waste material collection device having a multi-port valve, an outer vessel in fluid communication with the multi-port valve and an inner vessel contained within the outer vessel and in fluid communication with the outer vessel, the inner vessel configured to separate solid food waste materials from liquid wastes, wherein the inner vessel is positioned a distance from a bottom panel of the outer vessel, the distance in a range of from about 2.0 inches to about 5.0 inches; and at least one drain pipe positioned downstream from the multi-port valve;

wherein the multi-port valve is configured to selectively direct food waste materials to the outer vessel or direct food waste materials to the at least one drain pipe.

8. The drain system of claim 7, wherein the inner vessel includes a plurality of apertures configured to allow liquid waste materials to exit the inner vessel.

9. The drain system of claim 8, wherein the liquid waste materials exiting the inner vessel are contained within the outer vessel.

10. The drain system of claim 7, wherein a lid is positioned atop the outer vessel.

11. The drain system of claim 10, wherein a seal material is positioned between the lid and the outer vessel.

12. The drain system of claim 10, where the lid includes a hinged lid flap configured to receive food waste materials into the inner vessel.

13. A method of recycling solid food waste materials separated from liquid wastes, the method comprising the steps of:

grinding food waste materials with a garbage disposal, thereby forming ground food waste materials;

conveying the ground food waste materials to a solid food waste material collection device, the solid food waste material collection device having a multi-port valve, an outer vessel in fluid communication with the multi-port valve and an inner vessel contained within the outer vessel and in fluid communication with the outer vessel, the inner vessel configured to separate solid food waste materials from liquid wastes, wherein the inner vessel is positioned a distance from a bottom panel of the outer vessel, the distance in a range of from about 2.0 inches to about 5.0 inches;

conveying the ground food waste materials into the inner vessel;

receiving liquid waste materials exiting the inner vessel into the outer vessel, thereby forming solid food waste materials in the inner vessel;

removing the inner vessel from the solid food waste material collection device; and removing solid food waste materials from the inner vessel.

14. The method of claim 13, wherein the inner vessel includes a plurality of apertures configured to allow liquid waste materials to exit the inner vessel.

15. The method of claim 14, wherein the liquid waste materials exiting the inner vessel are contained within the outer vessel.

16. The method of claim 13, wherein a lid is positioned atop the outer vessel and wherein a seal material is positioned between the lid and the outer vessel.

17. The method of claim 16, where the lid includes a hinged lid flap configured to receive food waste materials into the inner vessel.

* * * * *